US006071837A

United States Patent [19]

Crook

[11] Patent Number: 6,071,837

[45] Date of Patent: Jun. 6, 2000

[54] TISSUE MEMBRANE FELT

[75] Inventor: Robert L. Crook, Wilson, N.C.

[73] Assignee: Voith Fabrics Heidenheim GmbH & Co KG, Heidenheim, Germany

[21] Appl. No.: 08/904,590

[22] Filed: Aug. 1, 1997

Related U.S. Application Data

[63] Continuation-in-part of application No. 08/676,744, Jul. 8, 1996, abandoned.

[51] Int. Cl.[7] ..... B32B 5/06

[52] U.S. Cl. ..... 442/268; 442/76; 428/397; 428/909; 162/116; 162/348; 162/338.1; 162/700; 162/903

[58] Field of Search ..... 442/76, 268; 162/116, 162/348, 338.1, 900, 903; 428/909, 397

[56] References Cited

U.S. PATENT DOCUMENTS 5,871,887 6/1994 Trokhan et al. ..... 430/320

FOREIGN PATENT DOCUMENTS 2 202 873 10/1988 United Kingdom .

2 254 287 10/1992 United Kingdom .

*Primary Examiner*—Richard Weisberger

*Attorney, Agent, or Firm*—Jacobson, Price, Holman & Stern, PLLC

[57] ABSTRACT

A membrane felt for a tissue making process using a Yankee or MG cylinder the membrane felt comprising a polymeric matrix membrane layer (11) and a supporting base structure (12). The polymeric matrix optionally at least partially encapsulates parallel yarns extending it at least one direction. The supporting base structure is a textile substrate. These are secured together, preferably via a batt fibre layer which may be needled between the supporting base structure and membrane layer.

12 Claims, 1 Drawing Sheet

TISSUE MEMBRANE FELT

This is a continuation-in-part application of Ser. No. 08/676,744, filed on Jul. 8, 1996, now abandoned.

The invention relates to a tissue membrane felt, and has particular, though by no means exclusive, reference to a tissue membrane felt to be used as a pick-up felt in a Yankee cylinder drying process.

A Yankee machine forms, presses and dries thin paper webs and consists of a forming section, a web pick-up arrangement which transfers the formed web to a press felt, known as a pick-up felt, and one or more press rolls, over which the felt with the web is turned so that the web is pressed directly against a heated Yankee cylinder.

Conventionally, a Yankee machine utilises a woven base pick-up felt in order to pick up a formed web from a forming section and transfer the formed web from the forming section to a heated Yankee cylinder for drying and creping. Due to the critical limits at high machine speeds of a Yankee machine, which can reach speeds of about 2000 m/min when the web grammage is about 17 g/m$^2$, the characteristics and quality of the pick-up felt are significant. Traditionally, the pick-up felt has a smooth surface. It must have the requisite density and water content in order to function properly. The pick-up function is affected by the water quantity, permeability and surface characteristics of the felt. Large quantities of water in the felt may improve its pick-up function, but this creates problems at the drying cylinder.

The primary object of this invention is to provide an alternative pick-up felt which has enhanced performance over previous pick-up felts, particularly in the areas of enhanced bulk and softness of the paper web.

It is a further object to provide a pick-up felt having uniquely resilient and compressible reinforcing elements disposed in the matrix of the felt with resistance to abrasive, chemical or heat degradation.

According to the present invention, there is proposed a membrane felt for a tissue making process using a Yankee or MG cylinder, the membrane felt comprising a supporting base structure and a foraminous non-woven membrane, wherein the foraminous non-woven membrane comprises a polymeric matrix optionally with parallel yarns extending in at least one direction and wherein the supporting base structure is a textile substrate.

The term "textile substrate" used herein relates to a substrate comprising fibers, filaments or yarns and does not include foams which do not include fibers, filaments or yams.

Preferably, the textile substrate is a woven base cloth, felt, membrane, non-woven assembly of spirally wound fabric or a non-woven assembly of fibrous strips.

The yarns may be monofilament or multifilament yarns.

Preferably, the polymeric matrix material is at least one of a polyamide, copolyester amide, polyester-polyether block copolymer or polyamide polyester block copolymer.

In a preferred embodiment of the invention a batt fibre layer is secured, preferably needled, between the supporting base structure and the non-woven membrane layer onto the supporting base structure thus forming a base structure-batt fibre-membrane assembly.

Preferably the batt fibre layer is manufactured from polyamide or polyolefin. The non-woven membrane may be secured to the top of the uppermost staple fibre layer.

Additionally, one or more layers of staple fibre may be needled onto the membrane-fibre-base cloth assembly at the paper contacting side of the felt, namely the membrane surface, whilst ensuring that the amount of staple fibre used in this regard is kept to a minimum so as not to mask the mesh pattern of the membrane.

Batt staple fibre may be needled into the base structure and membrane from the surface of the base structure which is opposite to the membrane side of the felt.

The staple fibre used in the present invention may be between 3–15 denier, preferably 3–6 denier, in order to provide the required strength to keep the woven basecloth and non-woven membrane intact when being used at performance critical limits and high machine speeds.

The non woven membrane may be of mesh form wherein the mesh layer includes yarns in the intended running direction thereof.

The membrane surface in contact with the web may be planar. However, preferably, it has a ribbed profile, so that at least some of the cross machine direction lands of the mesh membrane are raised with respect to the main plane of the mesh membrane. As an alternative or in addition to the raised cross machine direction lands of the mesh membrane, some of the machine direction lands may be raised with respect to the main plane of the mesh membrane forming a ribbed profile. The machine direction lands are raised by needling the membrane into the base structure so that the yarn containing machine direction lands are retained on the web-contacting surface of the felt whilst those machine direction lands with no yarns are displaced in the body of the felt.

In a further preferred embodiment of the invention the membrane surface in contact with the web may have a rectangular pattern. In such a construction some of the machine direction lands are raised above the main surface plane of the membrane, whilst others are depressed with respect to the plane. The raised machine direction lands contain multifilament or monofilament core yarns, and are raised as in the method described above. Thus, the raised machine direction lands, in combination with the transverse ribs in the cross machine direction, as mentioned above, create a rectangular mesh pattern on the surface of the membrane. This is illustrated in the drawings.

Preferably, two in every four of the running machine direction mesh lands are depressed with respect to the web-contacting surface of the felt, the remaining two running mesh lands containing yarns are raised with respect to the web-contacting surface of the felt, as described above. The yarn-containing pattern, together with the raised transverse cross machine lands which are preferably spaced apart at 2.5 mm intervals create a square or approximately rectangular mesh pattern on the surface of the membrane. This network of cells allow regions of bulked and unbulked paper fibres of the web to be formed.

The advantages of this arrangement are that the high surface contact area presented by the membrane improves adhesion of the web to the Yankee cylinder. Furthermore, the yarn-containing machine direction lands are slightly rigid in relation to the main surface plane of the membrane due to their relative inflexibility. The cross machine direction lands are also slightly rigid due to the fact that more membrane polymer is present, making them less flexible than the machine direction lands containing no yarns. This results in enhanced creping of the web which leads to an increase in web bulk and softness. The bulk is further improved by the differential specific pressure at the membrane ribs which are under high load when compared with the non-ribbed surface regions which are under much reduced load.

The supporting base structure may comprise a membrane structure of mesh form wherein the mesh layer includes yarns in one direction thereof. The membrane structure may be manufactured in accordance with the method described in GB 2202873-A. The edges of the membrane may be joined in accordance with the method described in GB 2254287.

The matrix material to be used in the present invention may be selected from a wide variety of polymeric materials. A preferred material is thermoplastic polyurethane in terms of resilience and compressibility. The compressible nature of such an elastomeric membrane material means that creping of the web is enhanced, thus contributing to the desired increase in web bulk and softness. Another advantage of the membrane when its surface is ribbed or rectangular is that it confers grid-like or ribbed symmetrical patterns into the web, thus creating an aesthetically pleasing product.

In a further preferred embodiment of the invention the membrane felt comprises a supporting base structure comprising a composite membrane structure, a second layer of up to 450 g/m$^2$ of needled batt fibre (6–15 denier), a third layer comprising a ribbed membrane on the web contacting side of the felt and an extra 50–150 g/m$^2$ fine surface batt fibre (3–6 denier) needled onto the base structure-batt fibre-membrane assembly.

The invention will now be described further, by way of example only, with reference to the accompanying drawings in which.

Figure 1:
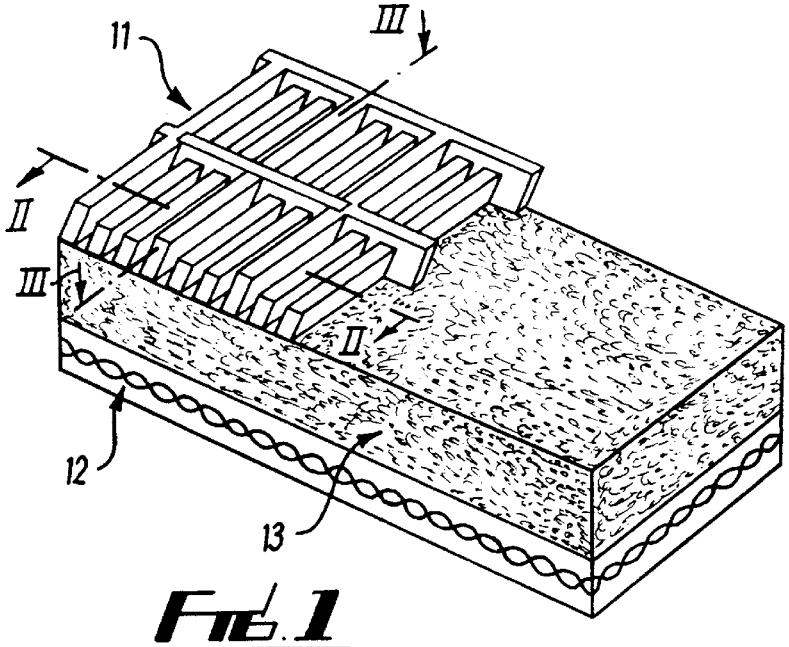
FIG. 1 is a diagrammatic perspective view of a cut away portion of membrane felt in accordance with the invention.

Referring now to the drawings, and particularly to FIG. 1 thereof, a membrane felt which may be used in a Yankee machine comprises a membrane layer 11 and a woven basecloth 12 secured together with batt staple fibre 13.

Figure 2:
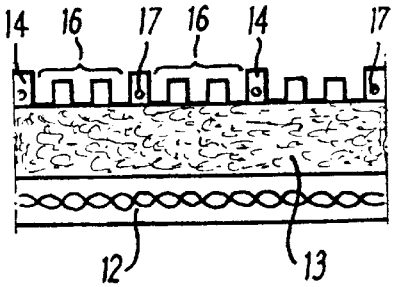
FIGS. 2 and 3 are enlarged sections taken on lines II—II and III—III respectively of FIG. 1.
Figure 3:
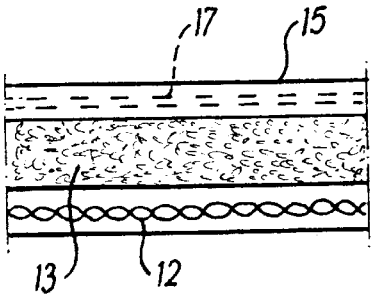
Figure 4:
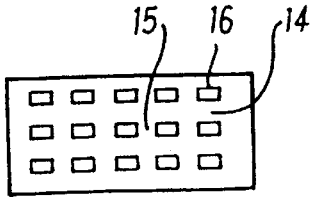
FIG. 4 is a plan view of the membrane layer of a membrane felt as illustrated in FIG. 1.

As illustrated in FIGS. 1, 2 and 3, membrane layer 11 presents longitudinally extending raised land areas 14 and transversely extending raised land areas 15 to give rectangular areas 16. Land areas 14 contain load bearing yarns 17 in the intended running direction of the membrane felt.

The differential specific pressure at land areas 14 and 15, which are under high load when the membrane felt is in use in a Yankee machine, is much higher than the pressure at rectangular areas 16 which are under reduced load. Consequently there is enhanced creping of the web which leads to an increase in web bulk and softness as well as less fibre compression in the low pressure areas.

The fibrous batt layer 13 is secured on one side thereof to the membrane layer 11. The other side of the fibrous batt layer 13 is secured to a woven basecloth by thermal bonding, by an adhesive, ultrasonic welding by needling or any conventional or other method. Ordinarily the fibres in the batt will be randomly oriented, but in some circumstances length orientation may be preferred.

Whilst in the embodiment under consideration, land areas 14 and 15 give rectangular areas 16 thus creating a square pressure pattern on the web-contacting membrane surface, this is not essential and the membrane may have a planar surface. Furthermore, the membrane may be ribbed in one direction only, for instance, the lands 14 containing the yarns 17 may be raised above the main surface plane whilst those containing no such reinforcing members are depressed with respect to the plane, with no raised transverse ribs, but instead depressed transverse ribs with respect to the main plane of the mesh membrane.

The membrane layer of the embodiment in consideration may be conveniently manufactured in accordance with the method described in GB-A-2202873, although other methods may be preferred, such as, for example, a powder dispersal technique.

The woven basecloth may be of conventional form and materials, capable of providing stability and water handling to the pick-up felt.

The batt may be secured to the woven basecloth, alternatively, the batt may be built up in situ on the woven basecloth by means of a meltblown technique wherein fibres are extruded onto the woven basecloth and, by virtue of their semi-molten state, adhere at their boundary surfaces to the basecloth. The degree of fineness of the fibres may be varied during batt build-up according to the specific requirements of the pick-up felt. It is to be appreciated that spun laced, spun bonded or other non-woven web creating techniques may also be used to create the batt.

It is to be appreciated that the thickness of the membrane, woven basecloth and batt staple fibre layer, if such a layer is used for securing the membrane/basecloth assembly, may be modified to accommodate the requirements of the web being formed, dried and creped in the Yankee machine.

It is to be understood that the above described embodiment is by way of illustration only. Many modifications and variations are possible.

What is claimed is:

1. A membrane felt for a tissue making process using a Yankee or MG cylinder, the membrane felt comprising a supporting base structure and a foraminous non-woven membrane, in the form of a grid defining lands extending in the machine running direction, and substantially orthogonally to said direction, at least some of said lands extending in each of said directions being raised with respect to a main surface plane of the membrane to create a network of cells which allows regions of bulked and unbulked paper fibres of the web to be formed.

2. A membrane felt in accordance with claim 1, wherein the textile substrate is a woven base cloth, felt, membrane, non-woven assembly of spirally wound fabric or a non-woven assembly of fibrous strips.

3. A membrane felt in accordance with claim 1, wherein the polymeric matrix material is at least one of a polyamide, copolyester amide, polyester-polyether block copolymer or polyamide-polyether block copolymer.

4. A membrane felt in accordance with claim 1, wherein the yarns are monofilament or multifilament yarns.

5. A membrane felt in accordance with claim 1, wherein a batt fibre layer is secured between the supporting base structure and the foraminous non-woven membrane layer.

6. A membrane felt in accordance with claim 1, wherein a batt fibre layer is secured between the supporting base structure and the foraminous non-woven membrane layer and wherein the batt fibre layer is manufactured from polyamide or polyolefin.

7. A membrane felt in accordance with claim 1, wherein a batt fibre layer is secured between the supporting base structure and the foraminous non-woven membrane layer and wherein the foraminous non-woven membrane is secured to a top of an uppermost batt fibre layer.

8. A membrane felt in accordance with claim 1, wherein a batt fibre layer is secured between the supporting base structure and the foraminous non-woven membrane layer and wherein one or more additional layers of batt staple fibre are secured at the membrane surface.

9. A membrane felt in accordance with claim 1, wherein a batt fibre layer is secured between the supporting base structure and the foraminous non-woven membrane and wherein batt staple fibre is needled into the membrane felt from a surface of the base structure which is opposite to the membrane side of the felt.

10. A membrane felt in accordance with claim 1, wherein a batt fibre layer is secured between the supporting base structure and the foraminous non-woven membrane and wherein batt staple fibre is between 3 to 15 denier.

11. A membrane felt in accordance with claim 1, wherein the polymeric matrix of the membrane has a rectangular pattern and all said lands in a machine direction are raised above said main surface plane of the membrane in combination with said raised ones of the orthogonally extending ribs.

12. A membrane felt according to claim 1, comprising a composite membrane supporting base structure, a base fibre layer up to 450 g/m$^2$ thereon, wherein batt fibre of said base fibre layer is 6 to 15 denier, a foraminous non-woven membrane on said base fibre layer comprising a polymeric matrix and yarns extending in a running direction thereof and a layer of fine surface batt fibre up to 150 g/m$^2$ needled onto a surface of the foraminous non-woven membrane wherein the fine surface batt fibre is 3 to 6 denier.

* * * * *